US007611142B2

(12) United States Patent
Kawashima et al.

(10) Patent No.: US 7,611,142 B2
(45) Date of Patent: Nov. 3, 2009

(54) SHEET CONVEYING APPARATUS AND IMAGE FORMING APPARATUS EQUIPPED THEREWITH

(75) Inventors: Hideki Kawashima, Kawasaki (JP); Hitoshi Nishitani, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 11/695,954

(22) Filed: Apr. 3, 2007

(65) Prior Publication Data

US 2007/0235920 A1 Oct. 11, 2007

(30) Foreign Application Priority Data

Apr. 7, 2006 (JP) ..... 2006-105766

(51) Int. Cl.
*B65H 7/02* (2006.01)

(52) U.S. Cl. ..... 271/228; 271/251; 271/248

(58) Field of Classification Search ..... 271/248, 271/250, 251, 225, 184, 185, 228
See application file for complete search history.

(56) References Cited

U.S. PATENT DOCUMENTS

| | | | | |
|---|---|---|---|---|
| 4,971,304 | A * | 11/1990 | Lofthus | 271/227 |
| 5,162,857 | A * | 11/1992 | Higeta et al. | 399/401 |
| 5,169,140 | A * | 12/1992 | Wenthe, Jr. | 271/228 |
| 5,697,609 | A * | 12/1997 | Williams et al. | 271/228 |
| 5,893,557 | A * | 4/1999 | Beduhn et al. | 271/228 |
| 6,273,418 | B1 * | 8/2001 | Fujikura et al. | 271/228 |
| 6,997,455 | B2 * | 2/2006 | Romine | 271/227 |
| 7,404,557 | B2 * | 7/2008 | Tada et al. | 271/226 |
| 7,445,208 | B2 * | 11/2008 | Onodera | 271/239 |
| 2004/0188929 | A1 * | 9/2004 | Tada et al. | 271/248 |

FOREIGN PATENT DOCUMENTS

| | | | |
|---|---|---|---|
| JP | 05043092 | A * | 2/1993 |
| JP | 7-334630 | | 12/1995 |
| JP | 8-208075 | | 8/1996 |

* cited by examiner

*Primary Examiner*—Kaitlin S Joerger
(74) *Attorney, Agent, or Firm*—Fitzpatrick, Cella, Harper & Scinto

(57) ABSTRACT

A sheet feeding apparatus includes a regulating member, provided along a feeding path of the sheet, for regulating a widthwise position of a sheet by being abutted by an edge of the sheet A sheet turning mechanism including a first pair of first driving roller and first follower roller for nipping and feeding the sheet is disposed at a position upstream of the regulating member, as is a second pair of second driving roller and second follower roller, where the first pair and the second pair are disposed in a line extending in a widthwise direction of the feeding path, and where the first and the second driving roller are rotatable in opposite directions to turn the sheet to abut the edge of the sheet to the regulating member. A sheet correcting mechanism is disposed downstream of the sheet turning mechanism, and includes a feeding roller and a third follower roller for correcting an attitude of the sheet by feeding the sheet so as to abut the edge of the sheet turned by the sheet turning mechanism to the regulating member.

9 Claims, 14 Drawing Sheets

(a)

(b)

(a)

(b)

(a)

(b)

SHEET CONVEYING APPARATUS AND IMAGE FORMING APPARATUS EQUIPPED THEREWITH

FIELD OF THE INVENTION AND RELATED ART

The present invention relates to a sheet conveying apparatus, with which an electrophotographic image forming apparatus, such as a copying machine, a facsimile machine, a printer, a multifunction machine made up of two or more of the preceding machines, etc. (which hereafter will be referred to simply as "image forming apparatus") is equipped, and which conveys a recording medium, such as a sheet of paper, an envelope, a postcard, etc., to the image forming portion of an image forming apparatus.

If a sheet of recording medium is conveyed askew, or becomes skewed while it is being conveyed, it becomes jammed and/or causes the formation of an image of lower quality. Thus, some sheet conveying apparatuses are provided with a mechanism for straightening a skewed recording sheet, that is, correcting the skew recording sheet in posture (which may also be called orientation or attitude) (for example, Japanese Laid-open Patent Applications 8-208075 and 7-334630).

FIGS. 12-14 show an example of a mechanism for straightening a skewed recording medium. This mechanism is provided with a sheet conveyance roller 802 which conveys a sheet 1 in the direction indicated by arrow mark A in the drawing, through a recording medium conveyance passage. The mechanism is also provided with an angled roller 803, which is disposed so that its rotational axis is angled by a preset amount relative to the recording medium conveyance direction A. A sheet 804 is pinched by the sheet conveyance roller 802 and angled roller 803. As the two rollers 802 and 803 are rotated, the sheet 804 is conveyed in the sheet conveyance direction A by the friction between the two rollers and sheet 804. Further, the mechanism is provided with a regulating plate 801, which is disposed in the adjacencies of one end of the two rollers 802 and 803. The regulating plate 801 is provided with a contact surface 801*a*, and is positioned so that the contact surface 801*a* is parallel to (coincides with) one of the lateral edges of the sheet conveyance passage. The mechanism is structured so that if the sheet 1*a* is delivered askew thereto, one of the lateral edges of the sheet 1*a* collides with the regulating plate 801, and then, the sheet 1*a* is conveyed further while being guided by the contact surface 801*a*. Thus, as the sheet 1*a* is conveyed further, the lateral edge of the sheet 1*a* comes into contact with the contact surface 801*a*; in other words, the sheet 1*a* is corrected in posture so that the lateral edges of the sheet 1*a* become parallel to the sheet conveyance direction A.

More specifically, as one of the lateral edges of the skew sheet 1*a*, the angle of which relative to the sheet conveyance direction A is Z, collides with the regulating plate 801, the angled roller 803 is rotated to apply to the sheet 1*a* a force that acts in a manner to twist the sheet 1*a* toward the contact surface 801*a*. As a result, the lateral edge of the sheet 1*a* is placed in contact with the entire range of the contact surface 801*a* of the regulating plate 801, being thereby made parallel to the sheet conveyance direction A; in other words, the sheet 1*a* is corrected in posture. After being corrected in the posture, the sheet 1*a* is conveyed further in the conveyance direction A while being guided by the contact surface 801*a* of the regulating plate 801. That is, the sheet 1*a* is corrected in posture as the edge of the sheet 1*a* is regulated in position by the regulating plate 801. Being simple in structure is the greater virtue of this sheet posture correcting mechanism rather than being capable of improving a sheet conveying apparatus in the level of accuracy at which it can convey a sheet of recording apparatus.

However, the abovementioned examples of the apparatuses depicted in FIGS. 12-14, and apparatus disclosed in Japanese Laid-open Patent Applications 8-208075 and 7-334630, suffer from the same problems, which will be described next.

As will be evident from FIG. 12, it is when the edge of the sheet 1*a* collides with the regulating plate 801 that the sheet 1*a*, which is being conveyed while remaining skew at an angle of Z, begins to be corrected in posture. The process of correcting the sheet 1*a* in posture, which begins as one of the lateral edges of the sheet 1*a* collides with the regulating plate 801, continues as the sheet 1*a* is conveyed with the lateral edge remaining in contact with the regulating plate 801. Then, the process ends as the lateral edge of the sheet 1*a* becomes parallel to the sheet conveyance direction A. In other words, until the point where one of the lateral edges of the skew sheet 1*a* comes into contact with the regulating plate 801, the skewed sheet 1*a* remains askew. Therefore, a distance X through which the skewed sheet 1*a* is conveyed before it comes into contact with the regulating plate 801 is a wasteful one; in other words, the recording sheet conveyance passage must be lengthened by the distance X beyond what would otherwise be necessary. Thus, this setup is problematic in that it increases the overall size of the apparatus.

Depicted in FIG. 13 is the case in which the angled sheet 1*a* has its lateral edge at a substantial angle Z to the conveyance direction A and comes into contact with the regulating plate 801. In this case, the distance Y through which this sheet 1*a* needs to be conveyed to be corrected in posture is greater than in FIG. 12 because the angle Z is greater. In comparison, FIG. 14 depicts a case in which the sheet 1*a* is at an angle Z that is relatively small, and comes into contact with the regulating plate 801. In this case, the distance Y through which the sheet 1*a* needs to be conveyed to be corrected in posture is relatively small because the angle Z is smaller. However, the smaller the angle Z, the longer the distance X through which the sheet 1*a* needs to be conveyed before it comes into contact with the regulating plate 801.

As will be evident from the explanations given above, if it is possible to reduce both the distance X, or the distance by which the sheet 1*a* needs to be conveyed before it comes into contact with the regulating plate 801, and the distance Y, or the distance by which the sheet 1*a* needs to be conveyed to be corrected in posture, the sheet conveyance passage can be substantially reduced in length as compared to when it is possible to reduce only one of the two distances X and Y. That is, if it is possible to ensure that the angle Z is not too large or too small, while ensuring that the distance X, or the distance by which the sheet 1*a* needs to be conveyed to be placed in contact with the regulating member 801, is as short as possible, it is possible to reduce the length of the conveyance passage, and therefore, it is possible to reduce the overall size of the apparatus. This relationship between the angle Z and the two distances X and Y attracted the attention of the inventors of the present invention.

SUMMARY OF THE INVENTION

Thus, the primary object of the present invention is to reduce as much as possible the distance by which a skewed sheet needs to be conveyed to be placed in contact with the regulating plate, and the distance by which the skewed sheet needs to be conveyed after the contact, to be corrected in posture, in order to provide a sheet conveying apparatus which is substantially smaller in size than a sheet conveying apparatus in accordance with the prior art.

Another object of the present invention is to provide an image forming apparatus which is equipped with a sheet conveying apparatus which employs a sheet conveying apparatus which is substantially shorter in the distance by which a skewed sheet needs to be conveyed to be corrected in posture than a sheet conveying apparatus in accordance with the prior art, and therefore, is substantially smaller in size than an image forming apparatus in accordance with the prior art.

Another object of the present invention is to provide an image forming apparatus which is substantially shorter, in the length of time a sheet of recording medium is conveyed through the apparatus, than an image forming apparatus in accordance with the prior art, being therefore substantially faster in process speed than an image forming apparatus in accordance with the prior art.

According to an aspect of the present invention, there is provided a sheet feeding apparatus comprising a regulating member, provided along a feeding path of the sheet, for regulating a widthwise position of a sheet by being abutted by an edge of the sheet. A sheet turning mechanism including a first pair of first driving roller and first follower roller for nipping and feeding the sheet is disposed at a position upstream of the regulating member, as are a second pair of second driving roller and second follower roller, where the first pair and the second pair are disposed in a line extending in a widthwise direction of the feeding path, and where the first driving roller and the second driving roller are rotatable in opposite directions to turn the sheet to abut the edge of the sheet to the regulating member A sheet correcting mechanism is disposed downstream of the sheet turning mechanism, and includes a feeding roller and a third follower roller for correcting an attitude of the sheet by feeding the sheet so as to abut the edge of the sheet turned by the sheet turning mechanism to the regulating member.

Further, the image forming apparatus in accordance with the present invention is provided with one or more image forming portions which form an image on a sheet of recording medium which is conveyed thereto by a sheet conveying apparatus in accordance with the invention.

The present invention can minimize the distance by which a skewed sheet needs to be conveyed to be corrected in posture, that is, to be conveyed for the lateral edge(s) of the skewed sheet to be rendered parallel to the normal sheet conveyance direction, in order to minimize the length of the sheet conveyance passage. Thus, the present invention can reduces a sheet conveying apparatus in size, being therefore capable of reducing the length of time a sheet of recording apparatus is conveyed in the apparatus.

Further, the present invention makes it possible for an image forming apparatus to be equipped with a sheet conveying apparatus in accordance with the present invention, contributing thereby to the reduction in the size of an image forming apparatus, and the improvement in the process speed of an image forming apparatus. Therefore, the present invention makes it possible to provide an image forming apparatus which is substantially smaller in size, and faster in process speed, than an image forming apparatus in accordance with the prior art. Thus, the present invention makes it possible to provide an image forming apparatus which is smaller and faster than an image forming apparatus in accordance with the prior art, and yet, in which a sheet of recording medium is delivered in correct posture (that is, without remaining skewed) to the image forming portion of the image forming apparatus so that a copy which is correct in the image position relative to the sheet of recording medium, and is high in quality, can be yielded.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, one of the preferred embodiments of the present invention, in the form of a sheet conveying apparatus for an image forming apparatus, will be described in detail with reference to the appended drawings.

Figure 1:
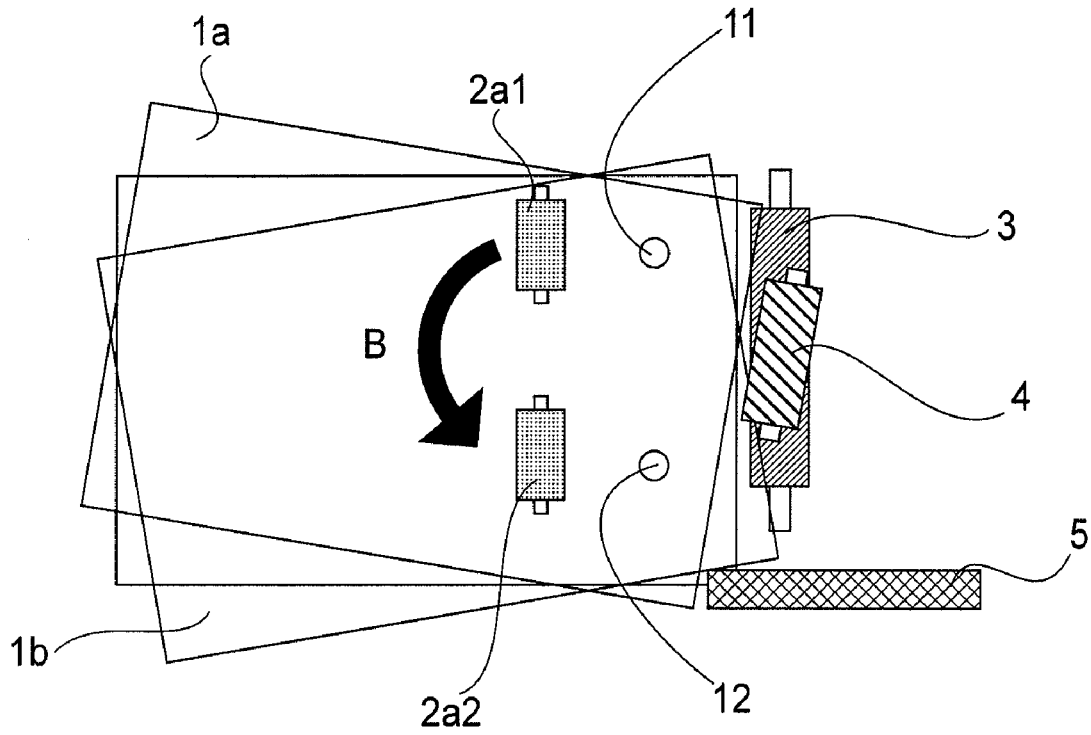
FIGS. 1(*a*) and 1(*b*) are schematic plan and side views, respectively, of the sheet conveying apparatus in one of the preferred embodiments of the present invention.
Figure 1:
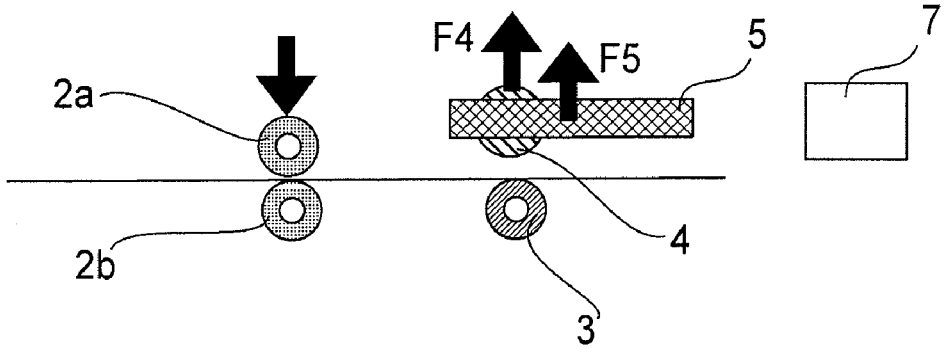

Referring to FIGS. 1(*a*) and 1(*b*), the sheet rotating mechanism as a sheet posture altering means is disposed so that it extends from one lateral edge of the sheet conveyance passage to the other. This sheet rotating mechanism has two pairs of rollers, that is, the top and bottom pairs of rollers. The top rollers are first and second driving rollers 2*a*1 and 2*a*2, and the bottom rollers are first and second follower rollers 2*b*1 and 2*b*2. The first and second driving rollers 2*a*1 and 2*a*2 are vertically movable so that they can be placed in contact with, or moved away from, the first and second follower rollers 2*b*1 and 2*b*2, respectively. As a sheet 1 is delivered to the sheet conveying apparatus, it is pinched between the first driving rollers 2*a*1, which is being rotated, and the first follower roller 2*b*1, and between the second driving roller 2*a*2, which is being rotated, and the second follower roller 2*b*2. As a result, the sheet 1 is conveyed by the friction between the sheet 1 and rollers.

In this embodiment, the first and second driving rollers 2*a*1 and 2*a*2 are positioned so that they align in the direction perpendicular to the sheet conveyance direction A, with the provision of a preset amount of interval, and also, so that they are on the left and right sides, respectively, of the center of the sheet conveyance passage.

Figure 2:
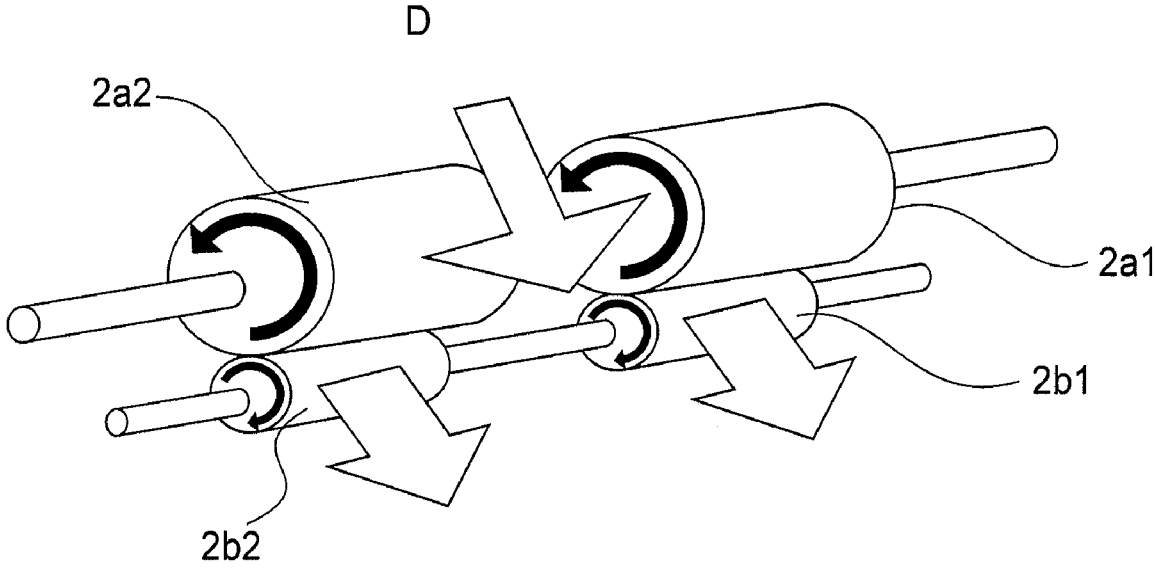
FIG. 2 is a perspective view of the sheet rotating ring mechanism, in the preferred embodiment, showing the direction in which a first roller pair made up of a first driving roller 2*a*1 and a first follower roller 2*b*1, and a second roller pair made up of a second driving roller 2*a*2 and a second follower roller 2*b*2, rotate when conveying forward a sheet of recording medium.
Figure 3:
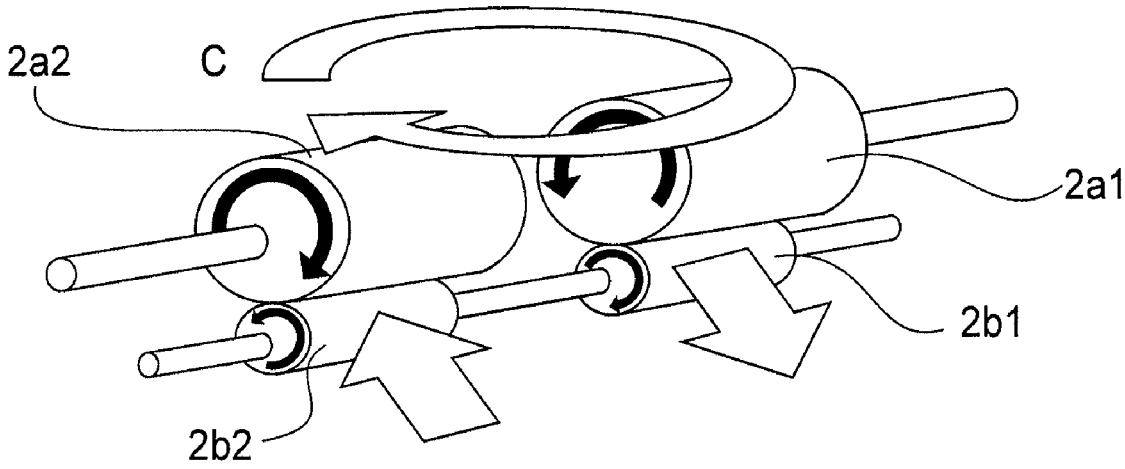
FIG. 3 is a perspective view of the sheet rotating mechanism, in the preferred embodiment, the left driving roller, which is the first driving roller 2*a*1, and the right driving roller, which is the second driving roller 2*a*2, are rotated forward and reverse directions, respectively, to rotate a skew sheet to prepare for posture correction.

Further, the first and second driving rollers 2*a*1 and 2*a*2 are individually drivable by two separate motors, one for one, and can be rotated in the same or different direction. Referring to FIG. 2, the sheet rotating mechanism is structured so that as the first and second driving rollers 2*a*1 and 2*a*2 are rotated in the same direction with the sheet 1 remaining pinched between the first and second pairs of rollers, the sheet 1 is conveyed straight in the direction indicated by an arrow mark D, and also, so that as the first driving roller 2*a*1 is rotated in one direction and the second driving roller 2*a*2 is rotated in the other direction with the sheet 1 remaining pinched between the first and second pairs of rollers, the sheet 1 is rotated in the direction indicated by an arrow mark C about an axis perpendicular to the sheet surface.

Referring to FIG. 1, disposed on the downstream side of the sheet rotating mechanism is a sheet posture correcting mechanism which is for conveying the skew sheet 1 in the downstream direction while correcting the sheet 1 in posture. The sheet posture correcting mechanism has: a sheet conveyance roller 3 (third driving roller) which rotates about its axle which is perpendicular to the sheet conveyance direction; and an angled roller 4 (third follower roller) which is rotated by the rotation of the sheet conveyance roller 3. It conveys the sheet 1 by pinching the sheet 1 between the conveyance roller 3 and angled roller 4.

The rotational axle of the angled roller 4 is angled relative to the rotational axle of the conveyance roller 3 in order to steer the sheet 1 so that the sheet 1 will be pressed (in the direction parallel to the width direction of the sheet 1) upon a regulating plate 5 as a sheet regulating member. With the presence of the angled roller 4, the sheet 1 is conveyed so that one of the lateral edges of the sheet 1, which is on the regulating plate side, will come into contact with the entire range of the sheet guiding surface 5*a* of the regulating plate 5. Further, the angled roller 4 and regulating plate 5 are upwardly retractable in the directions indicated by arrow marks F4 and F5, to their retracted positions, shown in FIG. 1(*b*), one for one, at which they do not contact the sheet 1. The angled roller 4 and regulating plate 5 are kept in their retracted positions when the first and second driving rollers 2*a*1 and 2*a*2 are conveying or rotating the sheet 1.

Designated by a referential number 7 is a recording head, as recording means, which records an image on the sheet 1 while the sheet 1 is conveyed by the conveyance roller 3. The recording head 7 may be an ink jet head or thermal head.

Designated by reference numbers 11 and 12 are first and second sheet sensors, respectively, as sheet detecting means, for detecting the sheet edge to detect the amount of the angular deviation of the sheet 1. The first and second sheet sensors 11 and 12 are disposed so that they align in the direction perpendicular to the normal conveyance direction, with the provision of a preset amount of interval.

A control circuit, which will be described later, receives the signals which the first and second sheet sensors 11 and 12 output as they detect the edge of the sheet 1, and determines, based on the points in time at which they detected the edge of the sheet 1, whether or not the sheet 1 is being conveyed askew. That is, if the first and second sheet sensors 11 and 12 detect the leading edge of the sheet 1 at the same time, the control circuit determines that the sheet 1 is not skew. If either the first sensor 11 or the second sensor 12 detects the leading edge of the sheet 1 ahead of the other, the control circuit determines that the sheet 1 is skew in a manner that the sheet is conveyed so that the side of the sheet, which was detected first, moves ahead of the side of the sheet 1, which was detected second. Further, the angle of the sheet 1 is computed from the difference between the point in time at which the sheet 1 was detected by the first sheet sensor 11, and that by the second sheet sensor 12. The control circuit, first sheet sensor 11, and second sheet sensor 12 make up the means for determining whether or not the sheet 1 is being conveyed askew.

Figure 8:
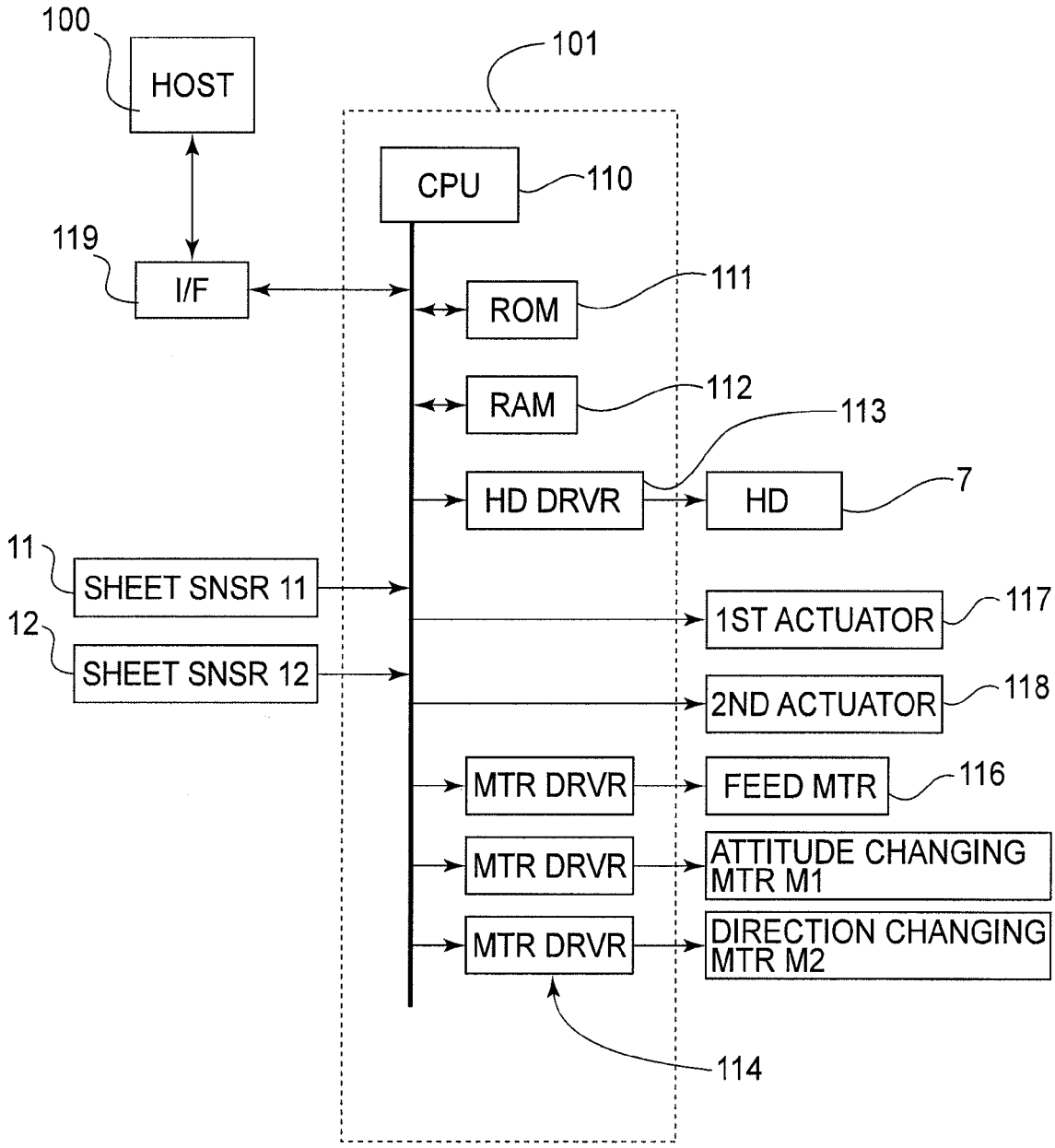
FIG. 8 is a block diagram of the control circuit in the preferred embodiment.

FIG. 8 is a block diagram of the control circuit in this embodiment.

The control circuit is on the substrate 101 of the control circuit board. The control circuit has: a CPU 110 which issues various control commands, such as the command for two-sided recording; a ROM 111 which stores the control data or the like; a RAM which serves as the area where the recording data or the like are developed; etc.

Designated by reference number 113 is a head driver which drives the recording head 7.

A sheet posture altering motor M1 is the motor for driving the first driving roller 2*a*1, and the sheet posture altering motor M2 is the motor for driving the second driving roller 2*a*2. A sheet conveyance motor 111 is the motor for driving the sheet conveyance roller 3.

Designated by reference number 114 are multiple motor drivers, more specifically, a motor driver for the sheet posture altering motor M1, a motor driver for the sheet posture altering motor M2, and a motor driver for the sheet conveyance motor 116.

Designated by reference number 117 is a first actuator for moving the first and second driving rollers 2*a*1 and 2*a*2 into their retracted positions in order to separate them from the first and second follower rollers 2*b*1 and 2*b*2, respectively. Designated by reference number 118 is a second actuator for separating the angled roller 4 from the sheet conveyance roller 3, and for moving the regulating plate 5 to the location in which the regulating plate 5 is outside the sheet conveyance passage. The first and second actuators 117 and 118 are provided with their own driving force sources, for example, a solenoid, a cam which is driven by a motor, etc.

Designated by reference number 119 is an interface which handles the data transmission between the image forming apparatus and a host apparatus, such as a computer, a digital camera, etc.

Figure 9:
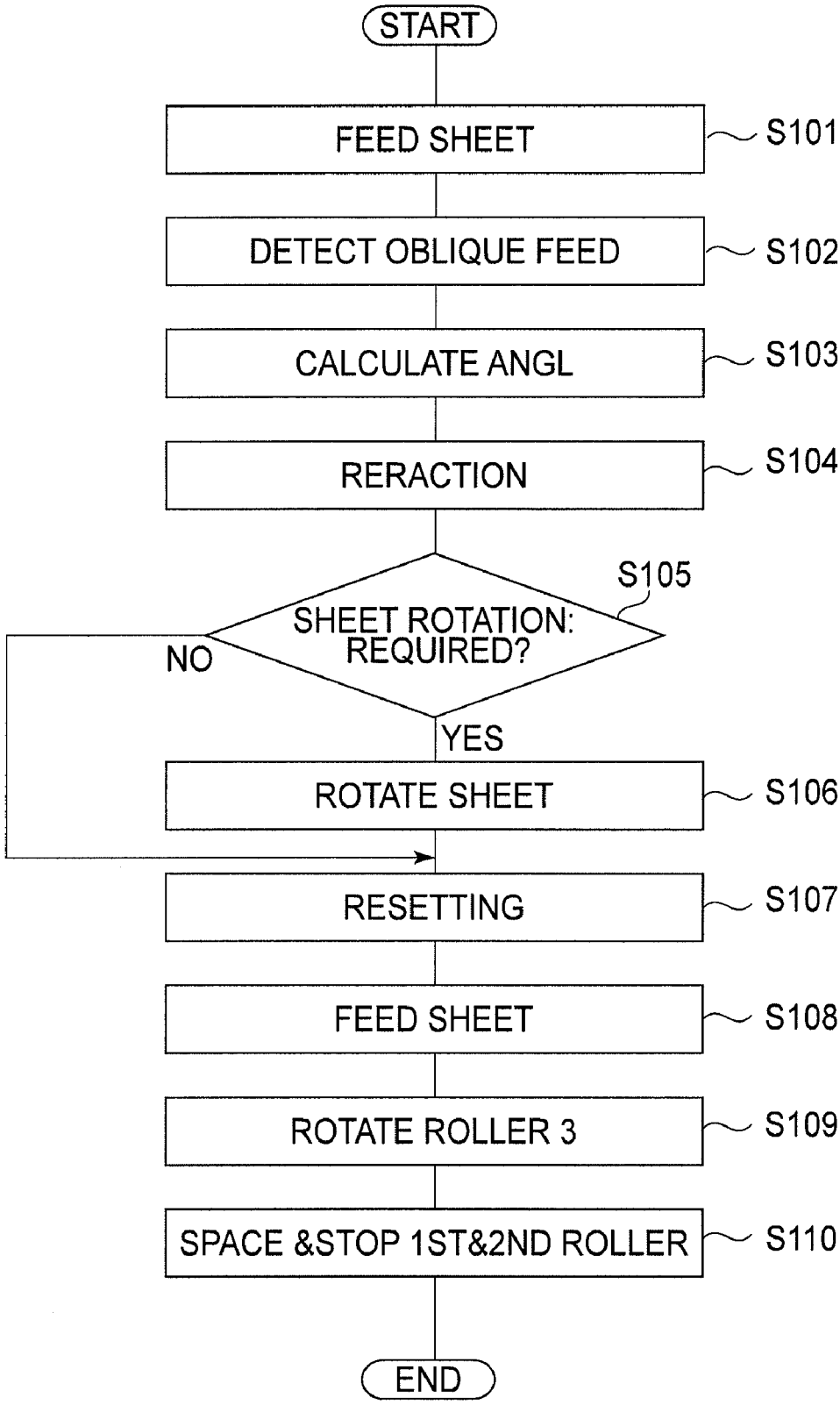
FIG. 9 is a flowchart of the control sequence for correcting a skewed sheet in posture, in the preferred embodiment.

Next, referring to the FIGS. 1-4, and the flowchart in FIG. 9, the operation in this embodiment for correcting a skewed sheet in posture will be described.

Referring to FIGS. 1(*a*) and 1(*b*), as the sheet 1 reaches the sheet rotating mechanism, it is pinched by the left roller pair (first driving roller 2*a*1 and first follower roller 2*b*1) and right roller pair (second driving roller 2*a*2 and second follower roller 2*b*2), and is further conveyed by the two pairs of rollers while remaining pinched by the two pairs of rollers (Step S101).

As the leading edge of the sheet 1 is detected by the first and second sheet sensors 11 and 12, the control circuit determines whether or not the sheet is askew, and if it determines that the sheet is askew, it determines in which direction the sheet 1 is skewed (Step S102). Then, the control circuit computes the amount of the angular deviation of the sheet 1, based on the difference between the point in time at which the leading edge of the sheet 1 is detected by the first sheet sensor 11, and that by the second sheet sensor 12 (Step S103).

Meanwhile, the angled roller 4 of the sheet posture correcting mechanism which is on the downstream side, and the regulating plate 5 which is also on the downstream side, are retracted to where they do not interfere with the sheet rotating operation, by driving the second actuator 118, as shown in FIG. 1(*b*) (Step S 104).

In Step S105, it is checked, based on the computed attitude or orientation and angle of the sheet 1, whether or not the sheet 1 needs to be rotated. If the sheet 1 needs to be rotated, the sheet 1 is rotated in the direction in which the sheet 1 needs to be rotated according to the direction in which the sheet 1 is skew, by the amount corresponding to the computed angle of the sheet 1, in Step S106. That is, the control circuit outputs signals for driving the sheet posture altering motors M1 and M2 so that the first driving rollers 2*a*1 rotates in one direction and the second driving roller 2*a*2 rotates in the other direction.

If the sheet 1 is skewed in the direction shown in FIG. 1(*a*), the first and second driving rollers 2*a*1 and 2*a*2 are rotated at the same time so that the first driving roller 2*a*1 is rotated in the clockwise (reverse) direction of FIG. 1(*b*), whereas the second driving roller 2*a*2 is rotated in the counterclockwise (forward) direction of FIG. 1(*b*), thereby rotating the sheet 1 in the direction indicated by an arrow mark B. As soon as the sheet 1 is rotated into a position outlined by a solid line designated by a referential character 1*b* in FIG. 1(*b*), the posture altering motors M1 and M2 are stopped.

If the regulating plate 5 is in the sheet regulating position when the sheet 1 is rotated as shown in FIG. 1(*a*), the sheet 1 collides with the regulating plate 5. Thus, before the sheet 1 begins to be rotated, the regulating plate 5 is moved into its retreat position to allow a part of the sheet 1 to rotate through the space, which the regulating plate 5 occupies when it is in the sheet regulating position. Therefore, the regulating plate 5 does not interfere with the sheet 1.

Next, in Step S107, the second actuator 118 is driven, moving thereby the angled roller 4 into the position in which the angled roller 4 presses the sheet 1 upon the sheet conveyance roller 3. At the same time, the regulating plate 5 is returned to the position in which the regulating plate 5 can guide the sheet 1 by the lateral edge of the sheet 1.

Hereafter, once the sheet 1*a* has been rotated into the position outlined by the solid line designated by reference character 1*b* in FIG. 1(*a*), it will be referred to as "rotated sheet 1*b*". In FIG. 1, the rotated sheet 1*b* is askew in the direction opposite to the direction in which the skewed sheet 1*a* is angularly deviated.

Figure 4:
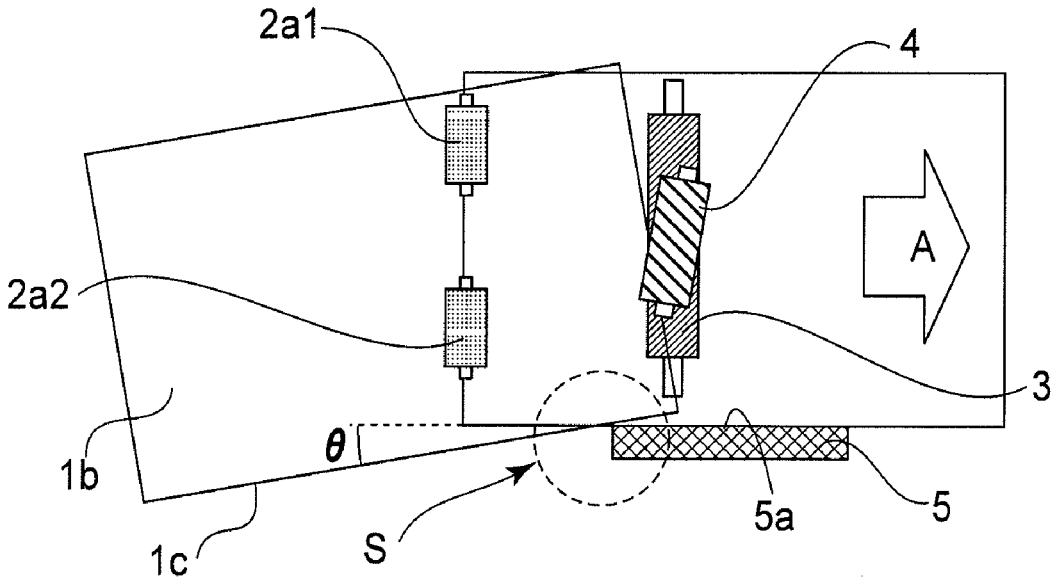
FIGS. 4(*a*) and 4(*b*) are schematic plan and side views, respectively, of the sheet conveying apparatus, showing the state of the sheet conveying apparatus, in which the sheet conveying apparatus has just begun to correct a skew sheet in posture.
Figure 4:
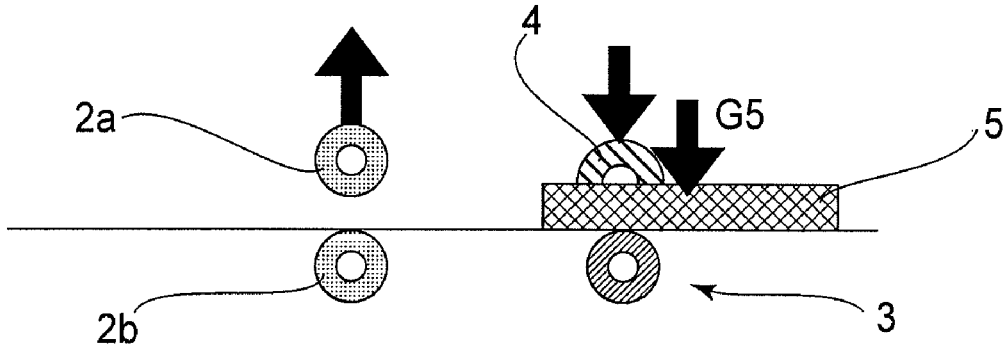

Referring to FIG. 4(*a*), the rotated sheet 1*b* is askew in such a direction that the distance between the rotated sheet 1*b* and regulating plate 5, in terms of the width direction of the rotated sheet 1*b*, gradually increases toward the leading edge of the rotated sheet 1*b*. That is, the lateral edge 1*b* of the rotated sheet 1*b* is oblique with reference to the guiding surface 5*a*; the angle of the lateral edge 1*c* of the rotated sheet 1*b* relative to the guiding surface 5*a* is θ.

The lateral edge 1*c* of the rotated sheet 1*b*, which is on the regulating plate side, is close to the upstream end of the regulating plate 5. While the rotated sheet 1*b* is in the above described state, the first and second driving rollers 2*a*1 and 2*a*2 are rotated at the same time in the counterclockwise direction of FIG. 1(*b*). As the two rollers 2*a*1 and 2*a*2 are rotated, the lateral edge 1*c* of the rotated sheet 1*b* almost immediately comes into contact with the upstream end of the regulating plate 5 (Step S108).

FIGS. 4(*a*) and 4(*b*) show the rotated sheet 1*b*, which is in the state in which the lateral edge 1*c* of the rotated sheet 1*b* has just come into contact with the upstream end of the regulating plate 5 (area surrounded by circle S). Virtually in synchronization with the moment of this contact between the rotated sheet 1*b* and regulating plate 5, the sheet conveyance roller 3 begins to be rotated by the sheet conveyance motor 116. As the sheet conveyance roller 3 is rotated, the rotated sheet 1*b* is pulled into the interface between the angled roller 4 and the sheet conveyance roller 3 (Step S109). Virtually at the same time as the rotated sheet 1*b* is pulled into the abovementioned interface, the first and second driving rollers 2*a*1 and 2*a*2 are separated from the first and second follower rollers 2*b*1 and 2*b*2, respectively, and the driving of the first and second driving rollers 2*a*1 and 2*a*2 is stopped, in Step S110.

The rotated sheet 1*b* is maneuvered by the angled roller 4 so that while the rotated sheet 1*b* is conveyed by the rotation of the sheet conveyance roller 3, the lateral edge 1*c* of the sheet 1*b* is placed in contact with the entire range of the sheet guiding surface 5*a* of the regulating plate 5. The process for correcting the sheet 1 in posture completes as soon as the sheet 1*b* begins to be conveyed with the lateral edge 1*c* of the sheet 1 being in contact with the entire range of the guiding surface 5*a*; in other words, the sheet 1*b* assumes the preset normal posture. Then, the sheet 1 (sheet 1*b*) is conveyed through the preset set path in the preset direction while remaining correct in posture. While the rotated sheet 1*b* is maneuvered by the angled roller 4, it is not in contact with the first and second driving rollers 2*a*1 and 2*a*2.

If it is determined in Step S105 that the sheet 1 does not need to be rotated, the sheet posture correcting process proceeds to Step S107.

Here, the statement that the sheet 1 does not need to rotated means that the angle between the lateral edge 1*c* of the sheet 1 and the sheet guiding surface 5*a* of the regulating plate 5 is close to the angle θ, that is, the difference between the angle between the lateral edge 1*c* of the sheet 1 and the sheet guiding surface 5*a* of the regulating plate 5 and the angle θ is no more than a preset value.

Further, there is a proper range for the angle by which the sheet 1 is to be rotated in Step S106 in proportion to the computed amount of the angle of the sheet 1 relative to the sheet conveyance direction. In other words, it is important that the sheet 1 is not rotated by an excessively large or small angle.

Figure 5:
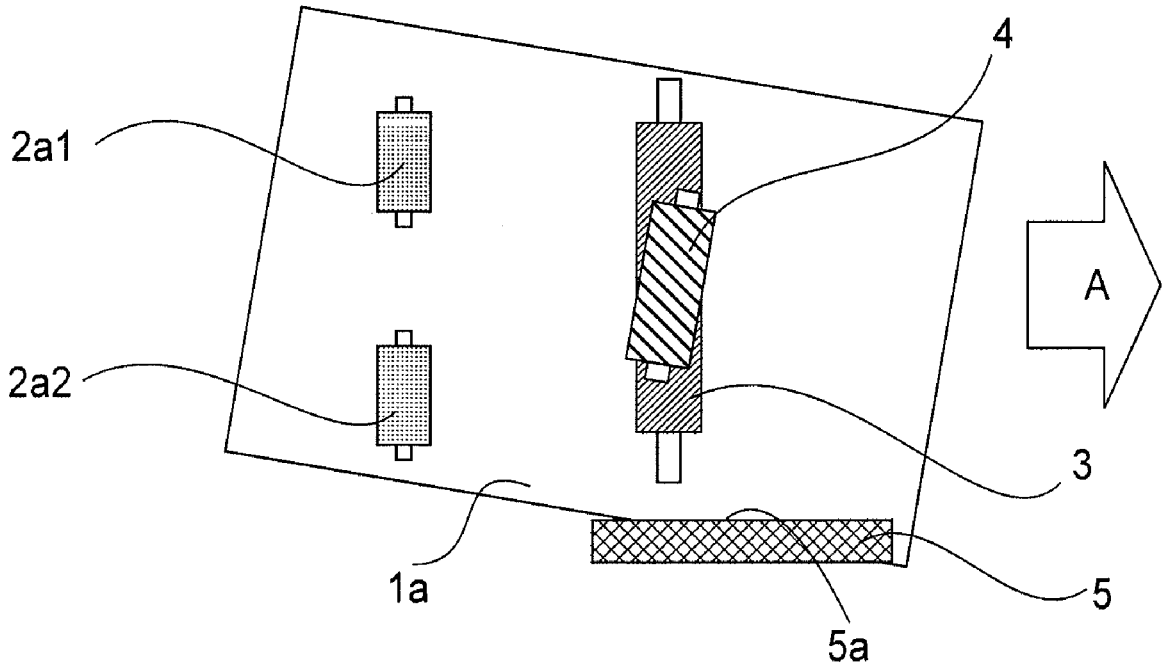
FIG. 5 is a schematic plan view of the sheet conveying apparatus, showing what will occur if the skew sheet is rotated by an insufficient amount.
Figure 6:
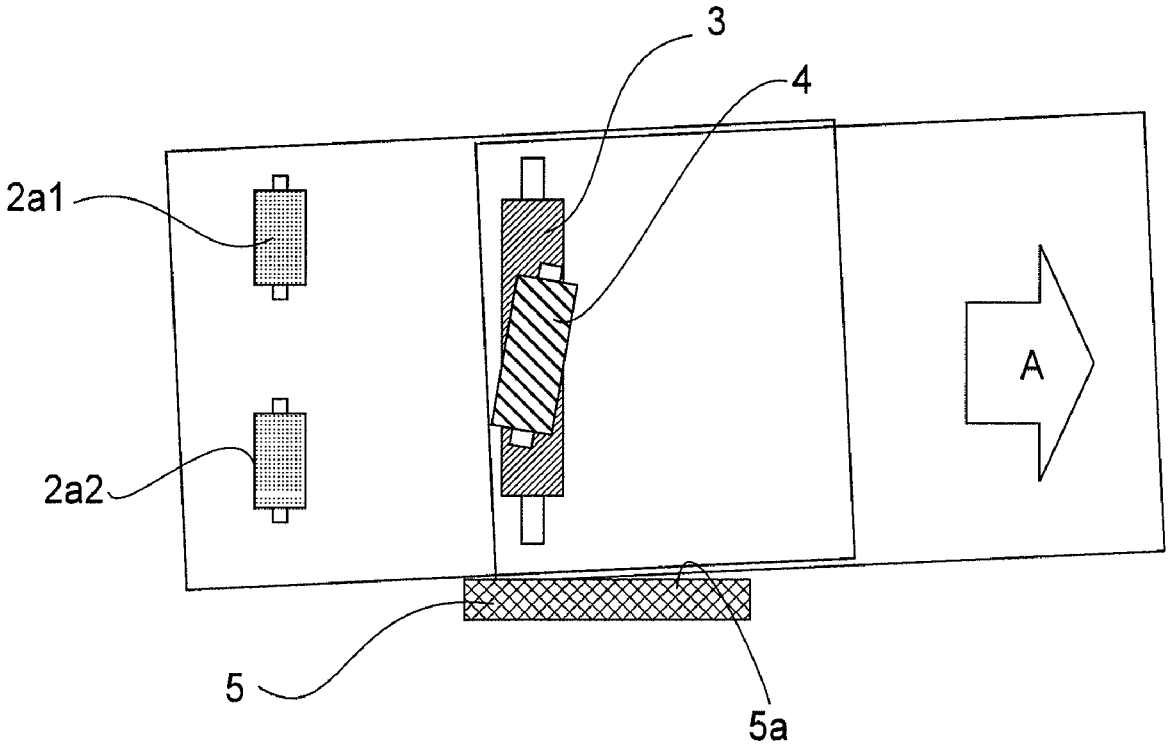
FIG. 6 is a schematic plan view of the sheet conveying apparatus, showing another case of what will occur if the skew sheet is rotated by an insufficient amount.

Referring to FIG. 5, if the angle by which the sheet 1 is rotated is too small, the rotated sheet 1*b* slides into the space below the regulating plate 5, making it impossible to regulate the rotated sheet 1*b* in posture, that is, to correct the rotated sheet 1*b* in posture. Further, if the distance between the sheet 1 and regulating plate, in terms of the width direction of the sheet 1, is greater than a certain value, the skewed sheet 1*a* fails to come into contact with the guiding surface 5*a* of the regulating plate 5; it passes by the regulating plate 5 without being guided by the guiding surface 5*a*, as shown in FIG. 6. If the skewed sheet 1*a* is sent into the image forming portion 7 without being corrected in posture because of the above described reasons, a low-quality copy, such as a copy the image on which suffers from positional deviation, is produced.

Figure 7:
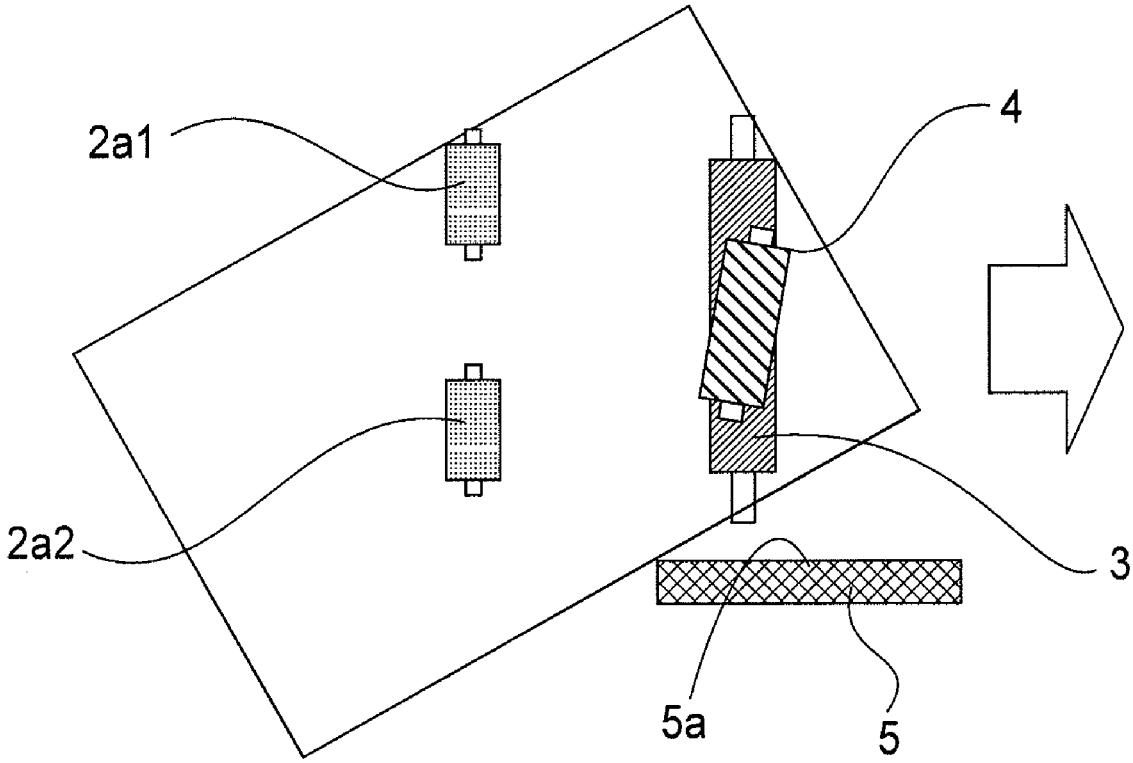
FIG. 7 is a schematic plan view of the sheet conveying apparatus, showing what will occur if the skew sheet is rotated by an excessive amount.

On the other hand, if the angle by which the sheet 1 is rotated is excessive, as shown in FIG. 7, the point of the lateral edge 1*c* of the rotated sheet 1*b*, by which the rotated sheet 1*b* comes into contact with the regulating plate 5, is subjected to a large amount of force, making it difficult for the rotated sheet 1*b* to be corrected in posture. In the case such as this, the sheet 1 fails to be completely corrected in posture, which results in the formation of a low-quality copy.

As will be understood from the above description of one of the preferred embodiments of the present invention, the skewed sheet 1*a* can be effectively corrected in posture by causing the lateral edge 1*c* of the skewed sheet 1*a* to come into contact with the upstream end of the regulating plate 5, as shown in FIG. 4(*a*), regardless of the direction in which the sheet 1*a* is askew and the angle at which the sheet 1*a* is conveyed askew. The distance and length of time the skewed sheet 1*a* needs to be conveyed to be corrected in posture can be minimized by ideally setting the angle θ which the lateral edge 1*c* of the sheet 1 will have relative to the guiding surface 5*a* when the sheet 1 comes into contact with the upstream end of the regulating plate 5. The value to which the angle which the lateral edge 1*c* of the sheet 1 will have when it comes into contact with the regulating plate 5 is set is very important. Thus, this angle is to be set according to the sheet material, sheet conveyance speed, and shape and material of the contact surface 5*a* of the regulating plate 5.

In Step S106, it is computed by how many degrees and in which direction the sheet 1 is to be rotated in order to set the angle of the lateral edge 1*c* of the sheet 1 relative to the guiding surface 5*a* to the value θ. Then, the sheet 1 is rotated according to the result of this computation.

For example, if the sheet 1 is skewed in the direction to cause the regulating plate side of the sheet 1 to proceed ahead of the opposite side thereof, and the angle of this lateral edge relative to the guiding surface 5*a* is greater than θ, the first driving roller 2*a*1 is to be rotated in the clockwise direction of FIG. 1(*b*) while rotating the second driving roller 2*a*2 in the counterclockwise direction at the same time. Then, as soon as the angle of this lateral edge relative to the guiding surface 5*a* becomes equal to θ while the sheet 1 is rotated in the direction opposite to the direction indicated by the arrow mark B, the rotation of the sheet 1 is stopped.

When stepping motors are used as the posture altering motors M1 and M2, the sheet 1 is rotated by the necessary amount of angle by controlling the number of steps. With the use of a control such as the above described one, it is possible to position the lateral edge 1*c* of the sheet 1, or the lateral edge of the sheet 1 on the guiding plate side, very close to the guiding surface 5*a*, in order to reduce to the target value, or "virtual zero", the distance by which the sheet 1 needs to be conveyed before the actual process for correcting the sheet 1 in posture. Further, because it is possible to set to a proper value in advance, the angle by which a skewed sheet needs to be rotated before the starting of the actual process for correcting the skewed sheet in posture, it is possible to design a sheet conveyance passage which is substantially shorter than that in accordance with the prior art. Thus, it is possible to realize a sheet conveying apparatus which is substantially smaller than a sheet conveying apparatus in accordance with the prior art, hence an image forming apparatus which is substantially smaller than that in accordance with the prior art. Moreover, the reduction in the length of the sheet conveying passage reduces the length of time a sheet must be conveyed. Thus, it is reasonable to expect that the present invention will substantially improve a recording apparatus in image formation efficiency.

The embodiment of the present invention described above with reference to a sheet conveying apparatus is only one example among the preferred embodiments of the present invention, and is not intended to limit the present invention in scope. That is, the above-described embodiment of the present invention can be modified in various forms, within the range of the gist of the present invention. Further, the present invention can be embodied in various forms different from the above described one. Further, the two or more embodiments of the present invention may be employed in combination.

For example, in order to make the sheet 1 collide with the end of the regulating plate 5 as shown in the circle designated by the referential character S in FIG. 4(*a*), it is necessary to rotate the sheet 1 until the lateral edge 1*c* of the sheet 1 is placed in the immediate adjacencies of the regulating plate 5. Therefore, it must be possible to control the position of the sheet 1 at a very high level of precision. Thus, a sheet sensor, which is capable of detecting the lateral edge 1*c* of the sheet 1, may be placed in the immediate adjacencies of the guiding surface 5*a* to make it possible to control the position of the sheet 1 at a very high level of precision. With the provision of this sheet sensor, it is possible to detect the arrival of the lateral edge 1*c* at the preset point in the immediate adjacencies of the guiding surface 5*a*, and therefore, it is possible to position the lateral edge 1*c* of the sheet 1 extremely close to the guiding surface 5*a* by stopping the rotation of the sheet 1 after rotating the sheet 1 by a preset angle after the detection of the lateral edge 1*a*.

Further, the angled roller 4 may be replaced with an ordinary follower roller, the rotational axis of which is parallel to that of the sheet conveyance roller 3. However, when replacing the angled roller 4 with an ordinary follower roller, it is necessary that the angle θ, or the angle the lateral edge 1*c* of the sheet 1 forms as it comes into contact with the regulating plate 5 as shown in FIG. 4(*a*), and the distance by which the sheet 1 is to be conveyed with the lateral edge 1*c* of the sheet 1 remaining in contact with the regulating plate 5 after coming into contact with the regulating plate 5, etc., are set to ideal values.

Figure 10:
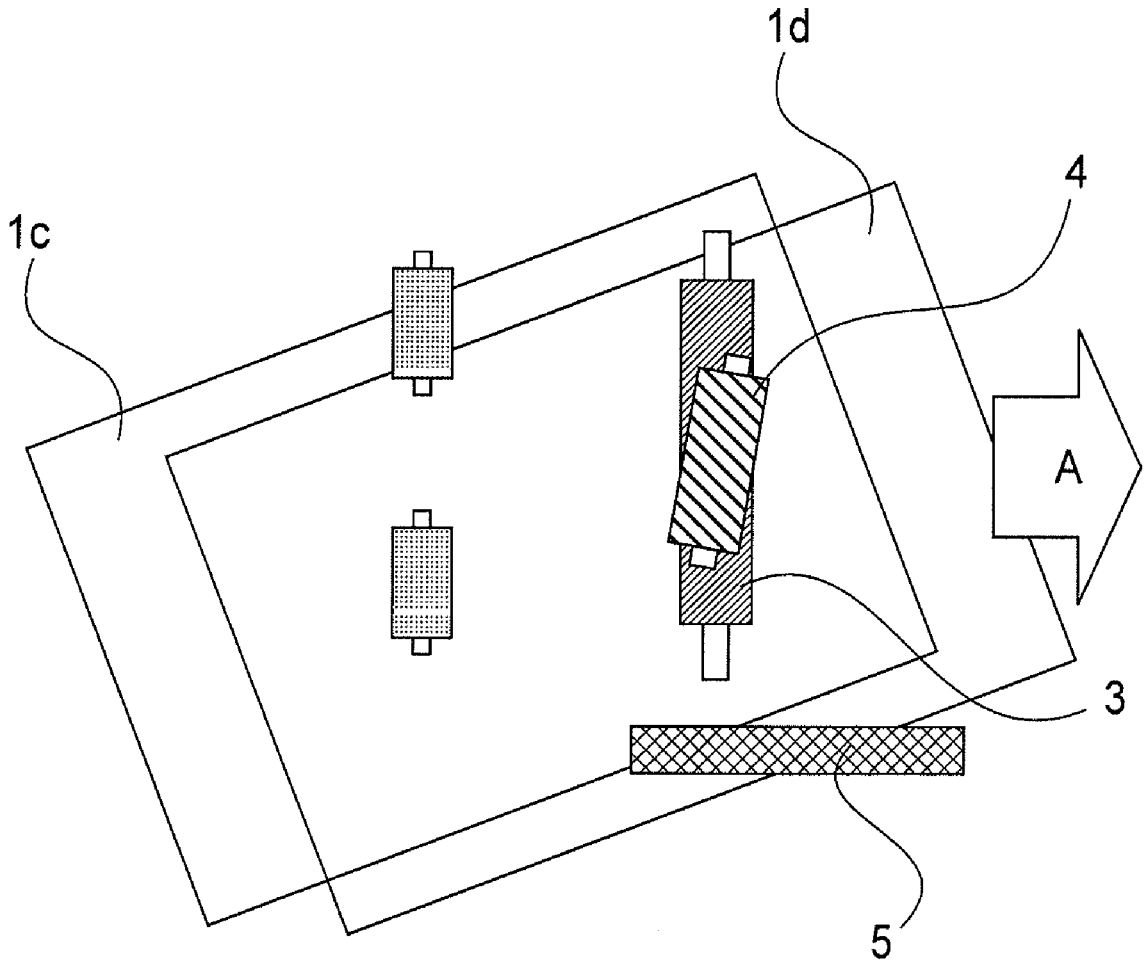
FIG. 10 is a schematic plan view of the sheet conveying apparatus, through which a skewed sheet is moving without being corrected in posture because the regulating plate failed to be lowered.

Further, if the problem that the regulating plate 5 fails to move downward, occurs, the sheet 1 moves forward without following the guiding surface 5*a*, remaining thereby skewed, as shown in FIG. 10. As a result, a paper jam occurs.

Figure 11:
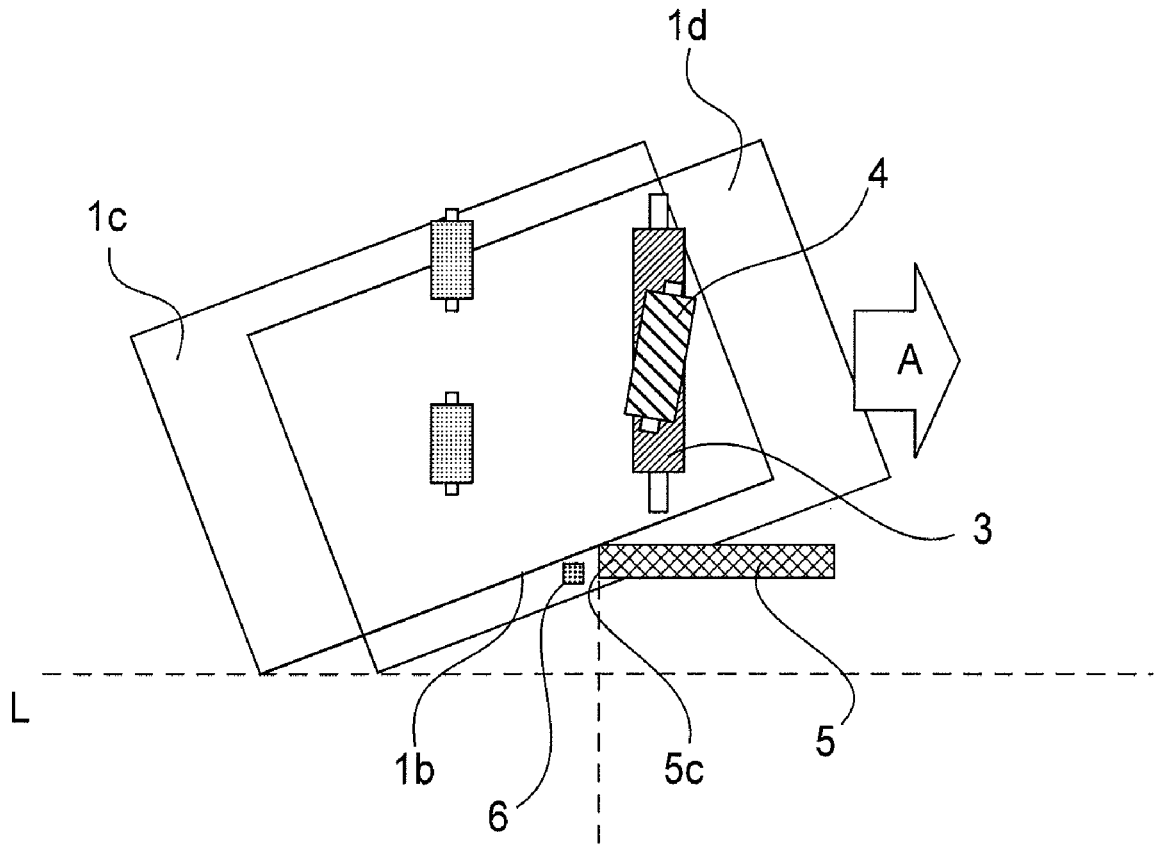
FIG. 11 is a schematic plan view of the sheet conveying apparatus, showing the positioning of the sheet sensor.
Figure 12:
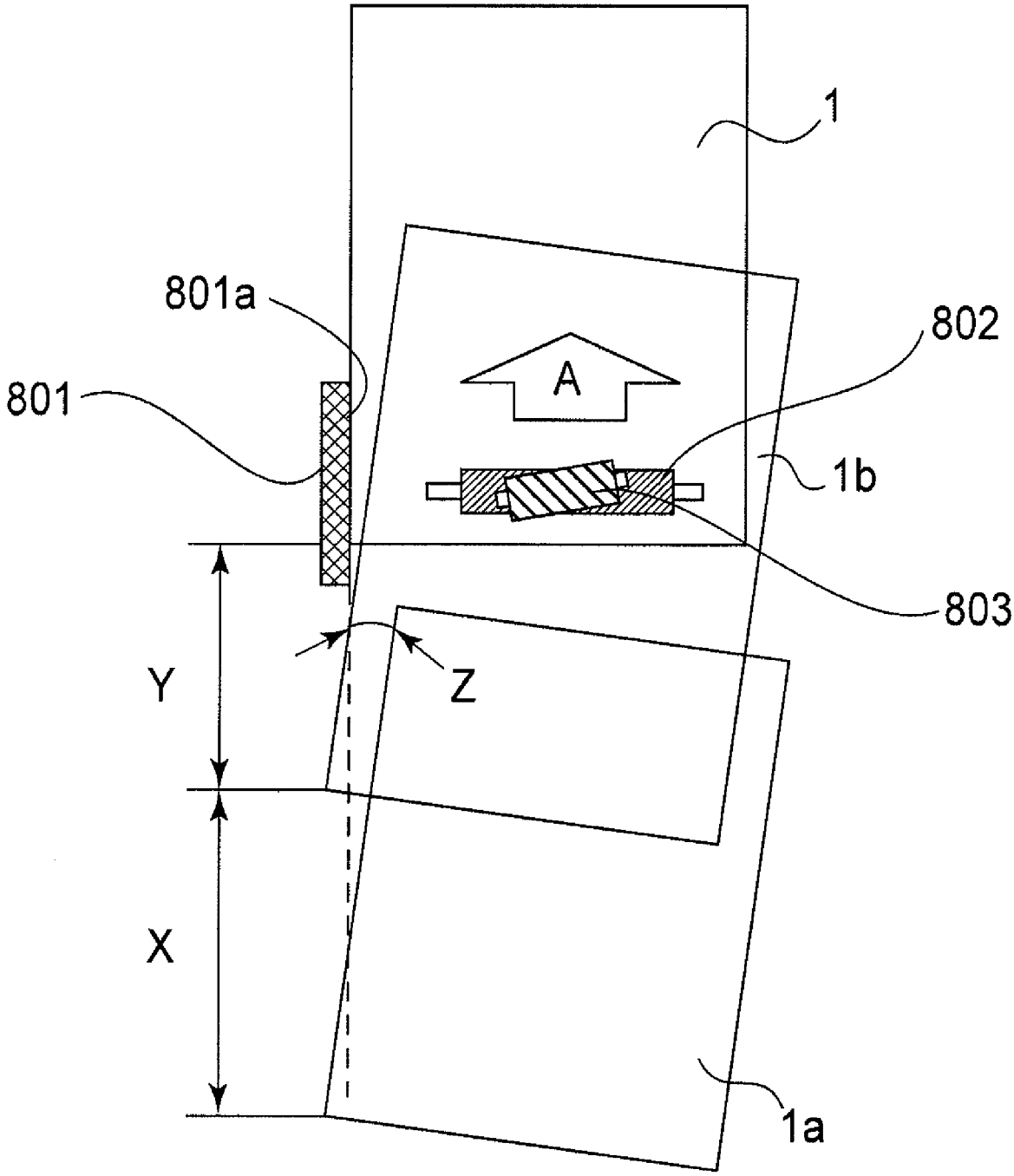
FIG. 12 is a schematic plan view of the sheet posture correcting mechanism in accordance with the prior art.
Figure 13:
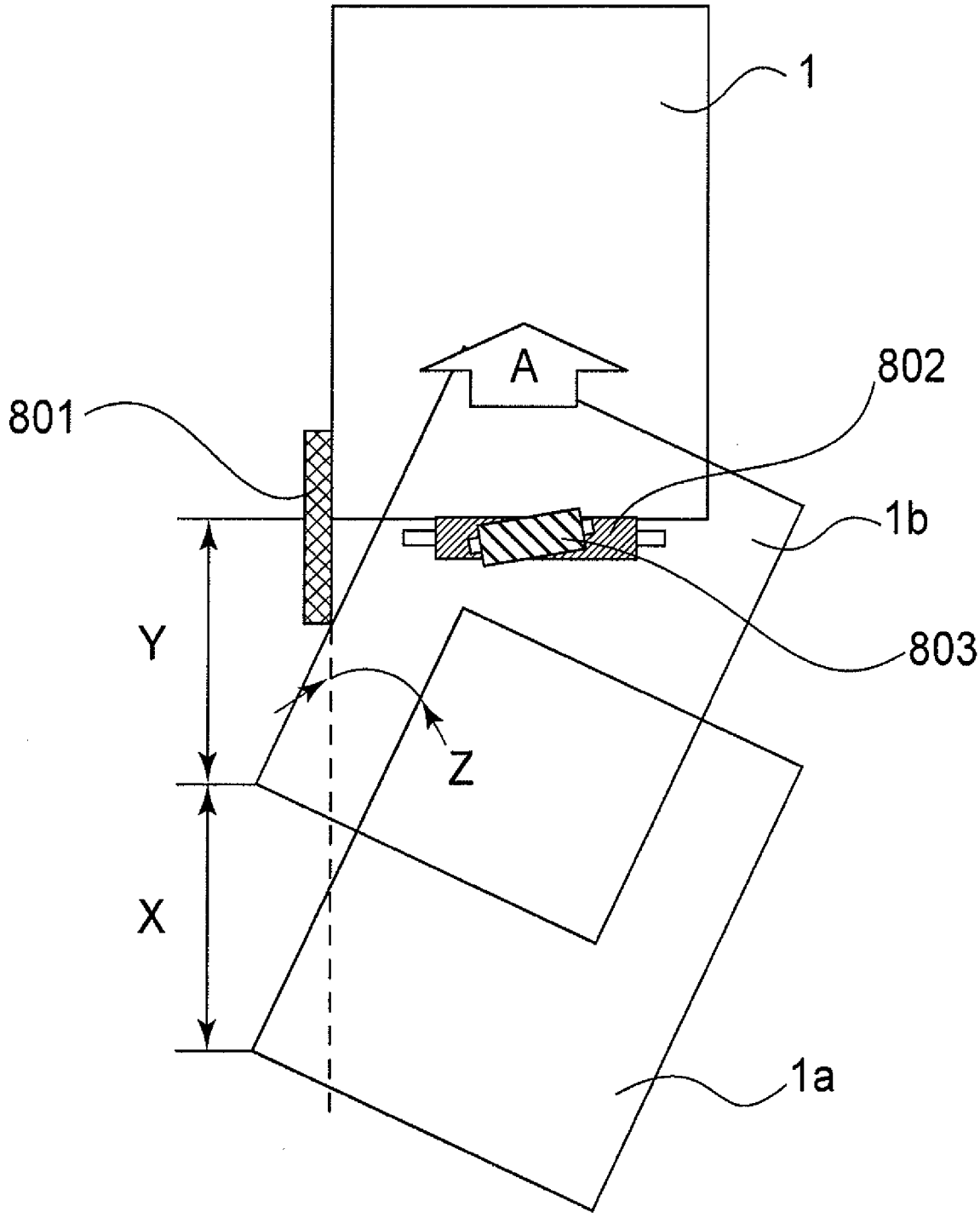
FIG. 13 is a schematic plan view of the sheet posture correcting mechanism in accordance with the prior art, and a skewed sheet, showing the angle of the skewed sheet relative to the sheet conveyance direction prior to the beginning of the process for correcting the skewed sheet in posture.
Figure 14:
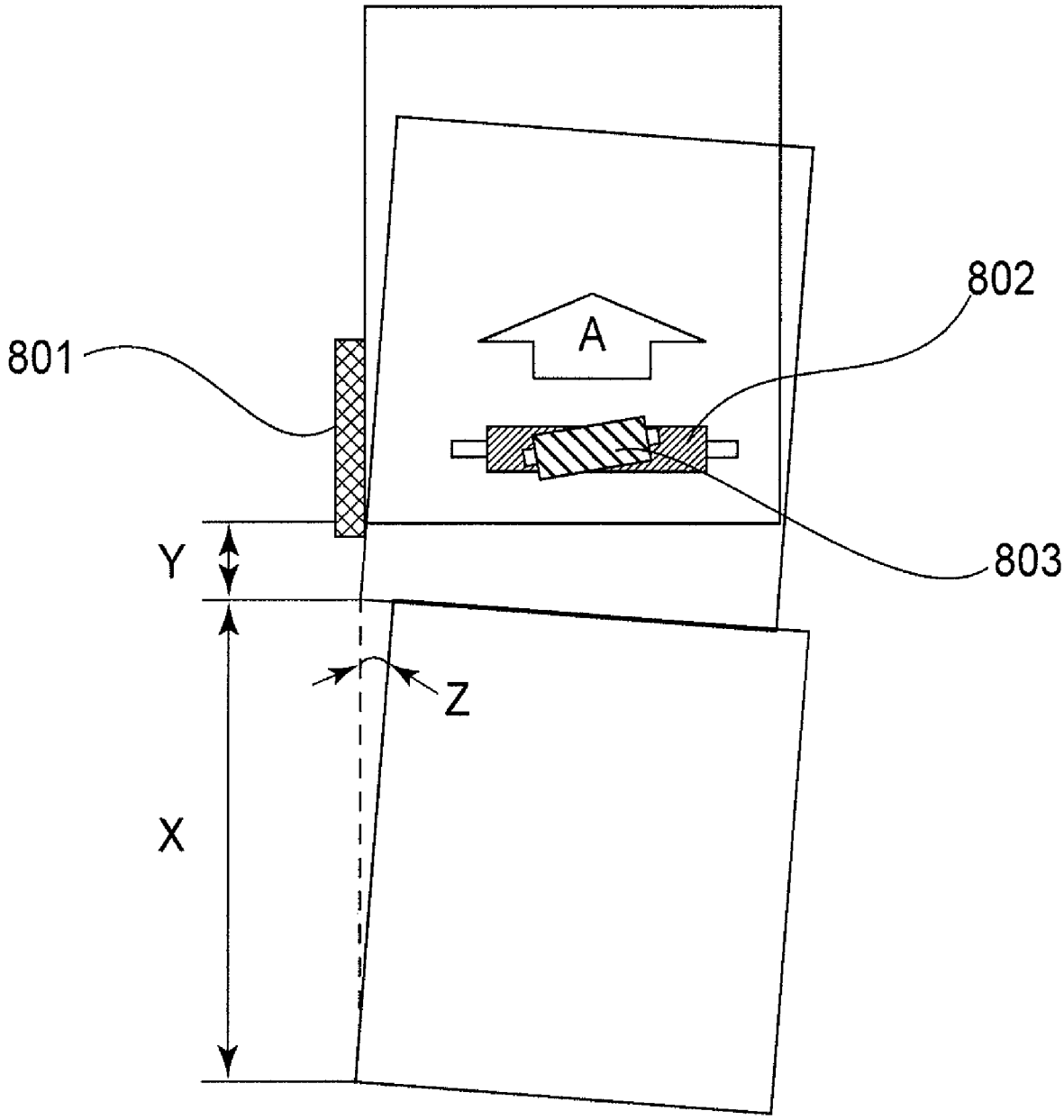
FIG. 14 is a schematic plan view of the sheet posture correcting mechanism in accordance with the prior art, and another skewed sheet, showing the angle of the skewed sheet relative to the sheet conveyance direction prior to the beginning of the process for correcting the skewed sheet in posture.

FIG. 11 is a schematic plan view of an example of a sheet conveying apparatus in accordance with the present invention, which is capable of preventing the problem that as the rotated sheet 1*b* fails to be normalized in posture, and a paper jam occurs. The sheet conveying apparatus in FIG. 11 is provided with a sheet sensor 6 for determining whether or not a skewed sheet is being conveyed without being corrected in posture. This sheet sensor 6 is disposed so that it will be on the downstream side of the point of the lateral edge 1*c* of the sheet 1, by which the sheet 1 comes into contact with the upstream end of the regulating plate 5 after being rotated by the sheet rotating mechanism. Further, the sheet sensor 6 is disposed on the upstream side of the straight line which is perpendicular to the sheet conveyance direction and coincides with the upstream end surface 5*c* of the regulating plate 5. Further, the sheet sensor 6 is disposed on the center side of a straight line L which coincides with the point at which the upstream end of the lateral edge 1*c* of the sheet 1 will be when the sheet 1 comes into contact with the upstream end of the regulating plate 5 after being rotated by the sheet rotating mechanism, and is parallel to the sheet conveyance direction. In other words, the sheet sensor 6 is in the area surrounded by the lateral edge 1*c* of the sheet 1, the line L, and the straight line which coincides with the upstream end surface of the regulating plate 5 and is perpendicular to the sheet conveyance direction.

If a skewed sheet reaches the sheet sensor 6 after being corrected in posture, the sheet sensor 6 does not respond to this sheet. However, if a skewed sheet reaches the sheet sensor 6 without being corrected in posture, that is, while remaining skew as outlined by the solid line designated by reference character 1*d*, it responds to the sheet. If the sheet sensor 6 responds to a sheet, the control circuit determines that the sheet conveying apparatus made an error in correcting the skewed sheet in posture. If the control circuit determines that the sheet conveying apparatus made an error in correcting the skewed sheet in posture, it causes the recording apparatus to discharge the sheet without allowing the sheet to be conveyed through the image forming portion.

The sheet sensor 6 may be used as a sensor for detecting the completion of the process for rotating a skewed sheet by the sheet rotating mechanism. When the sheet sensor 6 is used for such a purpose, the sheet is to be moved upstream of the regulating plate 5 by the first and second driving rollers 2*a*1 and 2*a*2 after the completion of the sheet rotating process, and the regulating plate is to be returned to its regulating position. Then, the process for correcting the skewed sheet in posture is to be carried out.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 105766/2006 filed Apr. 7, 2006, which is hereby incorporated by reference.

What is claimed is:

1. A sheet feeding apparatus comprising:

a regulating member for regulating a widthwise position of the sheet by being abutted by a lateral edge of the sheet;

attitude changing means for changing an attitude of the sheet;

inclined feeding means for correcting an inclination of the sheet by feeding the sheet with inclination in a direction of abutting the lateral edge of the sheet to said regulating member;

moving means for moving said regulating member and said inclined feeding means between respective correcting positions for correcting an inclination of the sheet and respective retracted positions in which said regulating member and said inclined feed means do not contact the sheet, wherein, in a state in which said regulating member and said inclined feeding means are in their respective retracted positions, said attitude changing means changes the attitude of the sheet inclinedly such that a trailing edge of the sheet is offset toward said regulating member, and thereafter, said moving means moves said regulating member and said inclined feeding means to their respective correcting positions to correct the inclination of the sheet by abutting a lateral edge of the inclined sheet to said regulating member.

2. An apparatus according to claim 1, wherein said attitude changing means includes two rotatable rollers which are rotatable in directions opposite to each other.

3. An apparatus according to claim 2, wherein said attitude changing means turns the sheet about an axis perpendicular to a surface of the sheet by rotating said two rollers in opposite directions.

4. An apparatus according to claim 3, wherein said two rollers are moved to positions in which said rollers do not contact the sheet after said moving means moves said regulating member and said inclined feeding means from their respective retracted positions to their respective correcting positions.

5. An apparatus according to claim 4, wherein said two rollers are moved to the positions not contacting the sheet, at a timing which is after said moving means moves said regulating member and said inclined feeding means from their respective retracted position to their respective correcting positions and which is after said inclined feeding means starts to feed the sheet and before the sheet abuts said regulating member.

6. An apparatus according to claim 1, wherein said regulating member has a sheet guiding surface and wherein said attitude changing means changes the attitude of the sheet such that edge of the sheet which is relatively closer to said regulating member forms a predetermined angle relative to said sheet guiding surface of said regulating member.

7. An apparatus according to claim 6, further comprising inclination detecting means for detecting an inclination angle of the sheet, wherein said attitude changing means is effective to turn the sheet by an angle corresponding to an inclination angle detected by said inclination detecting means.

8. An apparatus according to claim 1, wherein a part of the sheet passes through a space which has been occupied by said regulating member when it is at the correcting position in a process of attitude change operation by said attitude changing means.

9. An apparatus according to claim 1, further comprising an image forming station for forming an image on the sheet fed by said inclined feeding means.

* * * * *